US012234574B2

(12) United States Patent
Larkiala et al.

(10) Patent No.: US 12,234,574 B2
(45) Date of Patent: Feb. 25, 2025

(54) PRESSURE-BALANCING FEED-IN CONTAINER ARRANGEMENT AND METHOD FOR FEEDING MATERIAL

(71) Applicant: AALTO UNIVERSITY FOUNDATION SR, Aalto (FI)

(72) Inventors: Sauli Larkiala, Aalto (FI); Seppo Jääskeläinen, Aalto (FI)

(73) Assignee: AALTO UNIVERSITY FOUNDATION SR, Aalto (FI)

( * ) Notice: Subject to any disclaimer, the term of this patent is extended or adjusted under 35 U.S.C. 154(b) by 124 days.

(21) Appl. No.: 17/796,153

(22) PCT Filed: Jan. 29, 2021

(86) PCT No.: PCT/FI2021/050058
§ 371 (c)(1),
(2) Date: Jul. 28, 2022

(87) PCT Pub. No.: WO2021/152216
PCT Pub. Date: Aug. 5, 2021

(65) Prior Publication Data

US 2023/0067439 A1 Mar. 2, 2023

(30) Foreign Application Priority Data

Jan. 31, 2020 (FI) ..... 20205102

(51) Int. Cl.
*D01D 1/09* (2006.01)
*D01D 5/06* (2006.01)
*D01F 2/06* (2006.01)

(52) U.S. Cl.
CPC ..... *D01D 1/09* (2013.01); *D01D 5/06* (2013.01); *D01F 2/06* (2013.01)

(58) Field of Classification Search
CPC .... D01D 1/09; D01D 5/06; D01F 2/06; D01F 2/00
See application file for complete search history.

(56) References Cited

U.S. PATENT DOCUMENTS 3,670,362 A 6/1972 Hughes
5,176,645 A * 1/1993 Guerrero ..... A61M 5/204 604/150

(Continued)

FOREIGN PATENT DOCUMENTS

DE 102005036691 A1 * 2/2007 ..... B05B 9/0838
EP 1886937 A1 2/2008

OTHER PUBLICATIONS

International Search report for PCT/FI2021/050058, prepared by the Finnish Patent and Registration Office, mailing date Apr. 26, 2021, 4 pages.

(Continued)

*Primary Examiner* — Bob Zadeh
(74) *Attorney, Agent, or Firm* — Brooks Kushman P.C.

(57) ABSTRACT

A pressure-balancing feed-in container arrangement having a container forming a basic body, which container includes a container space in which a piston is arranged in a movable manner, which container space includes a first space portion, i.e. a gas side, and a second space portion, i.e. a material side, which are separated from each other by the piston, a feed pas-sage for feeding material into the material space, and a discharge passage for conducting the material from the material space, and means for connecting a pressure medium source with the gas side of the container, whereby the piston is provided with a piston rod extending towards the gas side and further through a container wall to the exterior of the container, whereby the material feed passage extends through the piston rod and the piston to the material side.

20 Claims, 1 Drawing Sheet

(56) References Cited

U.S. PATENT DOCUMENTS

Figure 1:
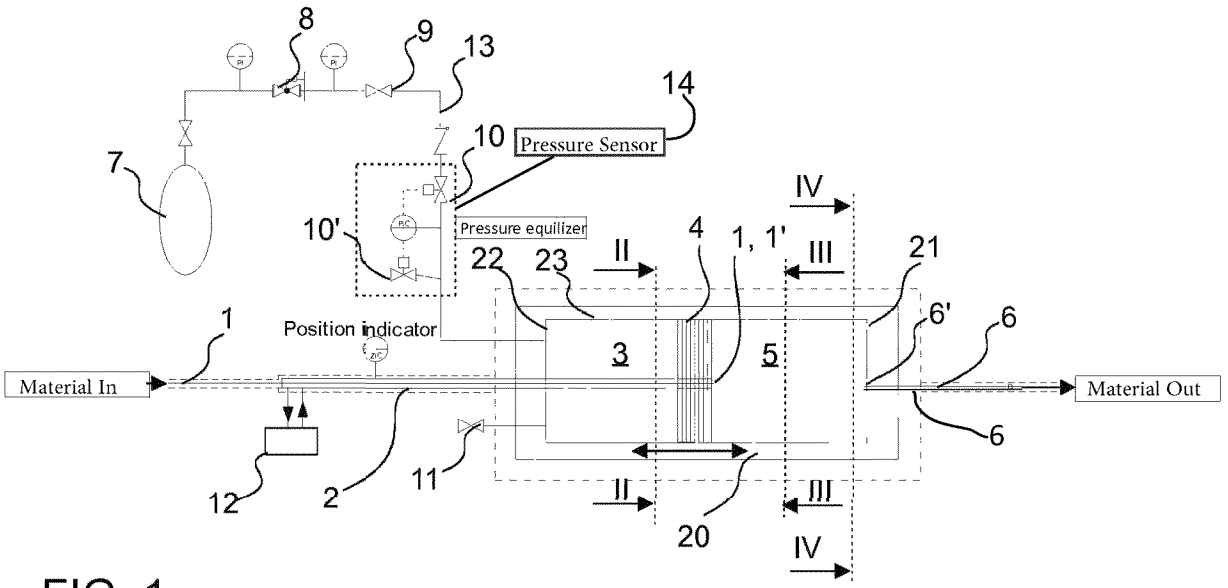

| | | | | | |
|---|---|---|---|---|---|
| 5,413,255 | A * | 5/1995 | Dent | A61D 7/00 | 222/387 |
| 5,826,978 | A * | 10/1998 | Zikeli | B29C 48/362 | 425/149 |
| 2023/0067439 | A1 * | 3/2023 | Larkiala | D01D 1/09 | |

OTHER PUBLICATIONS

Extended European Search Report for Application No. 21747113.5, dated Nov. 12, 2024, 9 Pages.

* cited by examiner

PRESSURE-BALANCING FEED-IN CONTAINER ARRANGEMENT AND METHOD FOR FEEDING MATERIAL

CROSS-REFERENCE TO RELATED APPLICATION

This application is the U.S. national phase of PCT Application No. PCT/FI2021/050058 filed on Jan. 29, 2021, which claims priority to FI patent application Ser. No. 20/205102 filed on Jan. 31, 2020, the disclosures of which are incorporated in their entirety by reference herein.

FIELD OF THE INVENTION

The invention relates to a pressure-balancing feed-in container arrangement and to a method for feeding material.

BACKGROUND OF THE INVENTION

In various processes in which material is conveyed and fed forward in the process it is often difficult to maintain uniform properties and pressure of the material. In such arrangements, an intermediate container into which the material is introduced and from which it is conducted further may have been used. In particular, high-viscosity substances or materials may be difficult to process. Especially in continuously-operated processes, feed-in containers are often used. The development of a pressure-balancing feed-in container began as part of a project, the purpose of which is to increase the production volume of Ioncell technology based fibres and to develop continuously-operated production. The technology is based on utilization of a wet spinning method in the production of fibres manufactured from dissolving pulp. In the process, ground and dried pulp is dissolved by means of an ionic liquid developed for the purpose into a homogeneous material, the properties of which include high viscosity at the production temperature. The spinning is carried out by passing the material through small holes at the wet spinning end. To ensure undisturbed production, the material must be kept free of air bubbles.

In the wet spinning stage, the most critical factor affecting the quality of the fibres is spinning pressure that is to be kept as constant as possible. By means of the pressure, a uniform material flow to the spinning ends is ensured. On a continuously-operated line it is almost impossible to maintain an invariable production rate through different stages of the process, so the system requires an intermediate container to provide a buffer. With high-viscosity materials, the storage in an intermediate container poses a technical challenge to come up with ways of driving the material out of the container to a possible pump. A pressure of several bar is required for moving the material in the piping, which is impossible to generate with a suction pump, the theoretical maximum suction capacity of which is achieved by means of a complete vacuum, whereby the pressure difference is appr. 1 bar. To solve the problem, the intermediate container is provided with a pressure accumulator and a check valve disposed on the inlet side. By means of them the material can be pressed out of the container in a controlled manner.

The operating principle of the traditional pressure accumulator comprises a piston/membrane disposed inside a container, a gas pressure acting on one side of the piston/membrane while the material is conducted to the other side via an inlet connection located at the bottom. A discharge connection is disposed at the same wall as the inlet connection to enable the maximum useful capacity. In the Ioncell process, the properties of the material being produced vary as a function time, as a consequence of which, in order to produce homogeneous fibres, the material flow must be continuous, and no portion must remain in the system for a significantly longer time than any other. The structure of the traditional pressure accumulator is such that the material driven first into the reserve leaves the container last. This rules out the use of intermediate containers having such structure.

In the spinning stage, pushing the material through the wet spinning ends requires a pressure of over 20 bar in order to work. Even slight pressure variations, and changes in the material flow such as fluctuation of the flow, directly affect the properties of the fibres. These requirements pose a particular challenge for the feed pump to achieve a completely uniform flow. Considering further the very high viscosity of the material, it is challenging to find a pump by which a sufficient pressure and pumping accuracy will be reached. One applicable solution is found in the gear pump. While this type of pump does not cause large variation in the pressure in operation, even this minor fluctuation can affect the properties of the fibres. In the process in question, keeping the material fluid requires the conditions to be maintained at a precise temperature. For the pump, this places a requirement of heatability, for example by means of a water-circulated jacket. Pumps fulfilling all the requirements are not found in the pump manufacturers' standard models, but the pumps must be manufactured on the basis of individual specifications, which makes the devices expensive.

A combination of devices enabling all the above-described properties would provide a very complex system, the operation of which would not be, however, anywhere near the optimum. As a solution to this, the aim was to develop a device that would take into consideration these challenges, utilizing a simple solution while emphasizing reduction of susceptibility of the system to faults.

SUMMARY OF THE INVENTION

The arrangement according to the invention is characterized by the features presented in the independent claim. Other embodiments of the invention are characterized by the features presented in other claims.

The invention generally relates to a pressure-balancing feed-in container arrangement.

In summary, it may be stated that the pressure-balancing feed-in container arrangement according to the invention is characterized in that it comprises:

- a container forming a basic body, which container comprises a container space in which a piston is arranged in a movable manner, which container space comprises a first space portion, i.e. a gas side, and a second space portion, i.e. a material side, which are separated from each other by the piston, a feed passage for feeding material into the material space,
- and a discharge passage for conducting the material from the material space, and means for connecting a pressure medium source with the gas side of the container, whereby the piston is provided with a piston rod extending towards the gas side and further through a container wall to the exterior of the container,
- whereby the material feed passage extends through the piston rod and the piston to the material side.

In the following, features of some embodiments of the invention are listed in a random order:

According to one embodiment the idea is that a material feed passage aperture and discharge passage aperture may be disposed at opposite edges of the material side. The advantage is that this ensures continuous replacement of the material in the material space and inside the device, which makes the arrangement useful also in processes in which a variable residence time changes the properties of the material.

According to one embodiment the idea is that the material feed passage aperture may be arranged at a surface of the piston facing the material space and the discharge passage aperture may be arranged at a wall of the material space opposite to the piston. The advantage is that this provides an operationally advantageous and efficiently directed material flow into the material space.

According to one embodiment the idea is that the pressure medium source may be a gas and/or liquid source. The advantage is that a relatively simple pressure medium source may be provided according to requirements of the application.

According to one embodiment the idea is that the pressure medium source may be a source of an inert gas, such as a nitrogen container. The advantage is that by using an inert gas, an arrangement applicable to many applications is provided. The arrangement may be implemented without electrical components and an inert gas, such as nitrogen, may be used for generating gas pressure. This way, it may be possible to classify the device also for an explosive environment, EX environment.

According to one embodiment the idea is that several discharge passages may be provided from the material space. The advantage is that the arrangement may this way be used on several production lines at the same time.

According to one embodiment the idea is that the feed-in container may be operatively coupled to act as a feed-in container for several parallel production lines. The advantage is that a separate feed-in container is not needed for each line, but depending on the application, a single container may be used.

According to one embodiment the idea is that a regulating valve arrangement may be arranged between the pressure medium source and the gas side of the container, which regulating valve arrangement may be operatively configured to provide a desired pressure on the gas side, for example by opening and closing a communication from the pressure medium source to the gas side of the container and/or by releasing pressure from the gas side.

According to one embodiment the idea is that a pressure difference may be configured to act on different sides of the piston in the container space at equilibrium, whereby the forces exerted on the piston may be equal such that the pressure may be on the gas side higher than on the material side, due to the smaller area of the piston on the gas side affecting the force, due to the piston rod. The advantage is that with a relatively simple arrangement, equilibrium may be efficiently provided in the container space of the arrangement.

According to one embodiment the idea is that the feed-in container arrangement may be operatively configured to act as a combination of a pressure equalization unit, an intermediate container and a pump as a part of a continuously-operated production line. The advantage is that with one relatively simple arrangement, a versatile operatively reliable combination may be efficiently provided to form part of a continuously-operated production line.

According to one embodiment the idea is that the feed-in container arrangement may be configured to receive and feed a high-viscosity material. The advantage is that high-viscosity materials may be challenging in practice, whereby with the arrangement, conditions for feeding high-viscosity materials may be provided efficiently and with a relatively simple arrangement.

According to one embodiment the idea is that the feed-in container and/or at least the feed passage or a part thereof may be temperature-regulated by a temperature regulating arrangement. The advantage is that the material being processed can be easily kept under desired temperature conditions.

According to one embodiment the idea is that the container may be a cylindrical container closed at both ends. The advantage is that a structure that is efficient, durable and advantageous in terms of manufacturing technology is provided for the container.

According to one embodiment the idea is that the piston may be configured to move in the container space according to a difference in the pressures of the gas side and the material side. The advantage is that this way a material space with a variable volume is provided, whereby it is easy to maintain a desired pressure.

According to one embodiment the idea is that the feed-in container arrangement may be configured to equalize changes in the pressure of the material side by means of movement of the piston and the gas side pressure regulating arrangement. The advantage is that the arrangement may be efficiently implemented with relatively simple components not requiring complex control arrangements.

The invention also relates to a method for pressure-balancing feeding of material, wherein the material is introduced to a material side of a container space of a pressure-balancing feed-in container arrangement as described above or below and conducted from there along a discharge passage, whereby in the method the pressure of the material is kept constant or at a desired value on the material side of the container space.

According to one embodiment the idea is that the pressure of the material on the material side may be regulated by means of a piston and pressure of a pressure medium acting on a gas side of the container space. The advantage is that the internal pressure of the material may be affected and it may be easily regulated.

According to one embodiment the idea is that the material to be fed may be a high-viscosity substance. The advantage is that in the method, an efficient and well-functioning solution is provided for the feeding of high-viscosity substances.

According to one embodiment the idea is that the material may be a homogeneous material dissolved from pulp, for example ground and dried pulp, by means of an ionic liquid. The advantage is that such relatively high-viscosity material may be efficiently introduced and further fed, whereby the pressure can be kept at a desired level and the properties of the material are not compromised. In addition, in the method the residence time of the material in the intermediate container may be minimized.

According to one embodiment the idea is that internal pressure of the material may be kept constant by means of variable volume of the material space and counterpressure of the pressure medium in the gas space. The advantage is that with a relatively simple arrangement, also the conditions for difficultly feedable materials can be efficiently kept constant.

According to one embodiment the idea is that the material being fed may be continuously replaced in the material space. This way the properties of the material are kept uniform, because no material is left in the material space for a long time, but it is efficiently introduced and discharged from opposite edges of the material space. This way the FIFO (first in first out) principle is efficiently realized for the material in the material space.

According to one embodiment the idea is that in order to maintain the properties of the material, devices of the feed-in container arrangement may be temperature-regulated by a temperature regulating arrangement. This way a desired temperature of the material may be efficiently maintained.

According to one embodiment the arrangement may act as a combination of a pressure equalization unit, an intermediate container and a pump as a part of a continuously-operated production line. By means of the device, high-viscosity substances, a controlled pumping of which from the intermediate container is otherwise very difficult, may be processed. Advantages of the arrangement include continuous flow through the device, such that no material is left in the container with a long residence time. Due to the structure of the invention, the device is capable of cutting off pressure variations from the system, whether they originate from the inlet or the outlet side. At the same time, by means of it a desired pressure level may be provided for the outlet side of the container.

According to one embodiment, due to the container structure it may be possible to use the invention to create a buffer on the production line, due to which for example from the container onwards, a continuous flow may be ensured regardless of variations in the production rate at the inlet end. The structure enables utilization of the buffer also in the other direction. The structure of the invention is sufficiently simple to implement the device on different scales.

According to one embodiment the pressure-balancing feed-in container may consist of a cylindrical container closed at both ends and forming a basic body, through which container the material flows. According to one embodiment, by means of the technical solutions the arrangement may be capable of equalizing the pressure of the output material to a specified value, which enables the container to be used for example as a feed pump. At the same time, the technology may enable the flow output from the container to be kept uniform. Thus, advantageously not even the slightest fluctuation is able to arise in the flow. According to one embodiment the container may use the pressure from the pressure medium, such as gas pressure or liquid pressure, as a power source, so the energy consumption remains low. The structure of the invention enables distribution of a uniform flow to several outlet lines, so it excellently functions as a feed-in container for several parallel lines.

The arrangement may be implemented without electrical components and an inert gas, such as nitrogen, may be used for generating the gas pressure. Thus, classification of the device also for an explosive environment, EX environment, may be possible. The device may provide the greatest advantage when processing very high-viscosity substances, for the processing of which there are no other well-functioning solutions available, by which the pressure can be kept sufficiently precisely constant. The operating principle may also be suitable for more fluid liquids and the benefits obtained therefrom can be utilized in full.

Inventive embodiments are also disclosed in the specification and drawings of this application. The inventive content of the application may also be defined in other terms as opposed to the claims presented hereinafter. The inventive content may also be constituted of several separate inventions, especially if the invention is considered in light of the express or implicit subtasks or in terms of the benefits or groups of benefits achieved. In this case, some of the features contained in the claims below may be redundant in terms of distinct inventive ideas. The features of different embodiments of the invention may be applied in connection with other embodiments within the scope of the basic inventive idea.

LIST OF THE FIGURES

Figure 2:
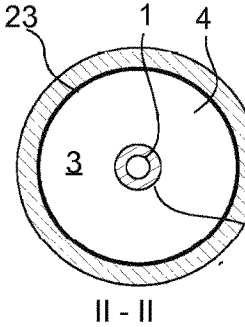
Figure 3:
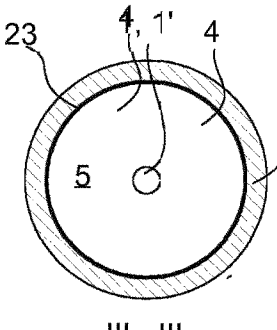
Figure 4:
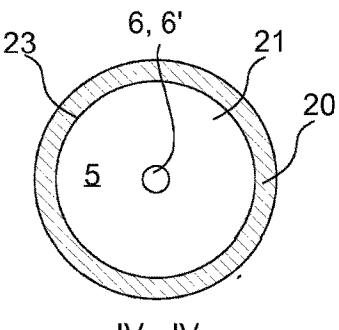

The invention will be described in more detail in the accompanying drawings, in which FIG. 1 schematically illustrates one pressure-balancing feed-in container arrangement, FIG. 2 schematically illustrates a simplified view of a section along line II-II of FIG. 1, FIG. 3 schematically illustrates a simplified view of a section along line III-III of the figure, and FIG. 4 schematically illustrates a simplified view of a section along line IV-IV of the figure.

DETAILED DESCRIPTION OF THE INVENTION

In some cases, the features presented in this application may be used as such, disregarding other features. On the other hand, the features presented in this application may be combined, if necessary, to form different combinations.

The operating principle of a pressure-balancing feed-in container arrangement according to one embodiment is illustrated as a simplified diagram in FIG. 1.

The pressure-balancing feed-in container arrangement may comprise a container 20 forming a basic body, which container comprises a container space 3, 5. In the container space, a piston 4 may be arranged in a movable manner. The container space may comprise a first space portion, i.e. a gas side 3, and a second space portion, i.e. a material side 5, which are separated from each other by the piston 4.

The arrangement may comprise a feed passage 1 for feeding material into the material space 5, and a discharge passage 6 for conducting the material from the material space 5. The arrangement may comprise means for operatively connecting a pressure medium source 7 with the gas side 3 of the container. According to one embodiment the means for operatively connecting the pressure medium source 7 with the gas side 3 of the container 20 may comprise a medium passage 13, for example a conduit.

According to one embodiment the piston 4 is provided with a piston rod 2 that may extend from the piston 4 towards the gas side 3. According to one embodiment the piston rod 2 may extend further through a container wall 22 to the exterior of the container.

According to one embodiment the material feed passage 1, for example a feed pipe, may extend through the piston rod 2 and the piston 4 to the material side 5 of the container space.

According to one embodiment a material feed passage 1 aperture 1' and discharge passage 6 aperture 6' are disposed at opposite edges of the material side 5. FIGS. 2, 3 and 4 illustrate simplified views of cross-sections of the arrangement of FIG. 1. For the purpose of clarity, an optional temperature regulating arrangement 12 has been left out from FIGS. 2, 3, and 4. According to one embodiment the piston rod 2 may comprise, in a longitudinal direction thereof, a channel that may be the material feed passage 1. The cross-sectional shapes of the container space, the piston and the piston rod are circular in the figures, but they may also be of another shape.

According to one embodiment the material feed passage 1 aperture 1' is arranged at a surface of the piston 4 facing the material space 5. According to one embodiment the material discharge passage 6 aperture 6' is arranged at a wall 21 of the material space 5 opposite to the piston 4.

According to one embodiment the pressure medium source 7 may be a gas and/or liquid source.

According to one embodiment the pressure medium source 7 is a source of an inert gas. According to one embodiment the source of an inert gas is a nitrogen container, such as a gas bottle.

According to one embodiment a regulating valve arrangement 10, 10' may be arranged between the pressure medium source 7 and the gas side 3 of the container. The regulating valve arrangement may be operatively configured to provide a desired pressure on the gas side 3, for example by opening and closing a communication from the pressure medium source 7 to the gas side 3 of the container and/or by releasing pressure from the gas side 3.

According to one embodiment a pressure difference may be configured to act on different sides of the piston 4 in the container space at equilibrium, whereby the forces exerted on the piston are equal such that the pressure is on the gas side 3 higher than on the material side 5, due to the smaller area of the piston 4 on the gas side 3 affecting the force, due to the piston rod 2. The cross-sectional area of the piston rod 2 thus taking up part of the effective area of the piston on the gas side 3.

According to one embodiment, several discharge passages 6 may be provided from the material space 5. According to one embodiment the feed-in container may be operatively coupled to act as a feed-in container for several parallel production lines.

According to one embodiment the feed-in container arrangement may be operatively configured to act as a combination of a pressure equalization unit, an intermediate container and a pump as a part of a continuously-operated production line.

According to one embodiment the feed-in container arrangement may be configured to receive feed a high-viscosity material.

According to one embodiment the feed-in container and/or at least the feed passage 1 or a part thereof is temperature-regulated by a temperature regulating arrangement 12.

According to one embodiment the container 20 is a cylindrical container closed at both ends 21, 22.

According to one embodiment the piston 4 is configured to move in the container space according to a difference in the pressures of the gas side 3 and the material side 5.

According to one embodiment the pressure-balancing feed-in container arrangement may be configured to equalize changes in the pressure of the material side 5 by means of movement of the piston 4 and the gas side 3 pressure regulating arrangement 10, 10'.

According to one embodiment a pressure sensor 14 may be operatively connected with the pressure control arrangement, which pressure sensor may be configured to control the valves 10, 10'.

According to one embodiment the arrangement may comprise a piston 4 position indicator. According to one embodiment the piston position indicator may be configured to measure a position of the piston rod. According to one embodiment the piston position indicator may be used for calculating the material flows and determining the degree of filling. The movement of the piston is illustrated in FIG. 1 with a double-headed arrow.

According to one embodiment the medium passage 13 between the pressure medium container 7 and the gas side 3 may be provided with at least one closing valve 9.

One embodiment relates to a method for pressure-balancing feeding of material, wherein the material is introduced to a material side 5 of a container space of a pressure-balancing feed-in container arrangement as described above and conducted from there along a discharge passage 6, whereby in the method the pressure of the material is kept constant or at a desired value on the material side of the container space.

According to one embodiment the pressure of the material on the material side 5 may be regulated by means of a piston 4 and pressure of a pressure medium acting on a gas side 3 of the container space.

According to one embodiment the material to be fed may be a high-viscosity substance.

According to one embodiment the material may be a homogeneous material dissolved from pulp, for example ground and dried pulp, by means of an ionic liquid.

Internal pressure of the material in one embodiment is kept constant by means of variable volume of the material space 5 and counterpressure of the pressure medium in the gas space 3.

According to one embodiment the material being fed may be continuously replaced in the material space.

According to one embodiment, in order to maintain the properties of the material, devices of the feed-in container arrangement or part of them are temperature-regulated, for example by a temperature regulating arrangement 12. According to one embodiment, in the temperature regulating arrangement a heat transfer medium may be circulated in channels formed or arranged in the structures. Relevant structures of a heat transfer arrangement of one embodiment are encircled in FIG. 1 by dashed lines. According to one embodiment the temperature regulating arrangement may be provided for the feed channel, the container and the discharge channel, for some of them or for a part thereof.

According to one embodiment the arrangement may be used in the following way:

The material to be processed is fed to the device along the feed passage 1, such as a feed pipe. The feed passage 1 or a part thereof may be temperature-regulated, i.e. tempered. The flow of the material may proceed in the material passage 1 freely through the piston rod 2 of the movable piston 4 to the material side 5 of the container. At start-up, when the material space of the container is empty, the piston is driven against the container edge located to the right in the figure, i.e. against the wall 21 of the material space located on the discharge aperture side. According to one embodiment this may be accomplished by means of the pressure acting on the gas side 3. The pressure may be generated for example by means of a pressure medium, by conducting it from the pressure medium container 7, for example a gas container, such as an inert gas container, for example a nitrogen container, by conducting the pressure medium along the medium passage 13 via a pressure reducer 8 to the regulating valve system 10, 10' that generates the desired pressure on the gas side by opening a gas flow into the container. The flow of the pressure medium stops when the desired pressure is reached. If the piston is displaced to the left in the figure away from the wall 21 located on the material outlet aperture side, the pressure on the gas side begins to climb. This opens a regulating valve 10' of the regulating valve system 10, 10' and releases excess gas. The valve opening sensitivity may determine the precision of the system. According to one embodiment the valve opening sensitivity should be such that the system is as precise as possible. Consumption of the pressure medium, such as gas or liquid, is moderate in the system, as according to one embodiment the pressure medium may be released only when the volume of the gas side 3 decreases due to the movement of the piston 4.

According to one embodiment, it may be essential to the operation of the container arrangement that the piston 4 separating the gas side 3 and the material side 5 is not allowed to touch either of the edges, i.e. the end walls 21, 22, during normal operation.

According to one embodiment, for example when the container system is put into operation, the discharge pipe 6 may be closed for the time of start-up with a valve (not shown in FIG. 1) and the material may be fed into the material space 5 of the container. The flowing material collects in the container, in the material space thereof, moving at the same time the piston 4 to the left in FIG. 1, away from the wall 21 on the side of the material discharge aperture 6'. According to one embodiment the container space 3, 5 of the container is filled with the material about to the halfway point before the discharge pipe 6 is opened, for example by opening the valve, and the normal running begins. This way, for operation, the container has an equal buffer in both directions.

According to one embodiment, in optimum conditions the same material flow enters the material space 5 from the material feed side, for example along the feed passage 1, from the feed aperture 1', and leaves from the material discharge side, for example along the discharge passage 6, via the discharge aperture 6'. This keeps the piston immovably in the container space and the container only acts as a pressure equalizer.

According to one embodiment, if more material is driven into the container than what leaves the container, the piston moves slowly to the left in FIG. 1, i.e. away from the wall 21 on the side of the discharge aperture 6'. When the ratio of the flows is opposite, also the direction of the piston movement is reverse. According to one embodiment the arrangement is maintained operative even if either one of the material flows should stop altogether. According to one embodiment the operating time of the arrangement may in this case be dependent on the position of the piston when the material flow stops and on the capacity of the container that may be sized to offer a desired reserve for the process. On the production line this provides a possibility for example for the maintenance of one end without shutting down the other.

The open structure of the device between the inlet and outlet lines efficiently equalizes pressure. In order to ensure continuity of the flow, the pressure of the inlet side must be higher than of the outlet side. If the pressure drops, the direction of the flow is reversed. This may be prevented by providing the inlet side with a check valve or by using a feed pump model with an operating principle preventing backflow. The amount of the pressure difference needed is in practice the pressure needed for exceeding the flow resistance of the inlet pipe. A greater pressure difference is not possible, because the device equalizes excess pressure with the movement of the piston. Feeding of the material to the device may be carried out, inter alia, by a constant flow pump such as, for example, a gear pump.

Compared to the traditional intermediate containers, the device may provide a significant advantage relating to replacement of the material. The inlet and outlet pipes of the device are disposed at opposite edges of the material side. This ensures continuous replacement of the material inside the device, which makes the device useful also in processes in which a varying residence time changes the properties of the material. FIG. 1 illustrates a solution in which there is one feed and discharge line, i.e. one feed passage 1 and one discharge passage 6. According to one embodiment, structurally there is no obstacle to providing the container with multiple feed lines and/or discharge lines without changing the operating principle. This is particularly useful when the container is used as a feeder for several parallel lines.

According to one embodiment the area of the internal cross-section of the feed line may be significantly smaller compared to the diameter of the piston located in the container. According to one embodiment the pressure acting on the material side 5 may exert on the piston 4 a force (F), the magnitude of which is the product of pressure (p) and area (A) ($F=p*A$). The magnitude of effective area is the difference of area of the piston and internal diameter of the feed line. According to one embodiment a change in the flow rate of the feed or the discharge side tends to change the pressure acting in the container, providing a significant change in the force exerted on the piston, which is reflected as immediate change in the pressure of the gas side. The precise pressure equalizer system reacts immediately to this, in consequence of which the pressure is equalized quickly and the piston 4 is able to move easily. This shows as capability of the apparatus to efficiently equalize even large pressure variations.

According to one embodiment the material side of the apparatus may be a completely closed system, which prevents the access of excess air/gas into the process. The only possible contact interface for the material with the gases can develop in consequence of a poorly sealed piston. This may be avoided by sufficiently good quality of inner surface 23 of the container space of the cylinder, and properly sized piston seals. If the seals break, a leak is more likely from the gas side to the material side. This is due to the small pressure difference acting across different sides of the piston at equilibrium. In order for the forces exerted on the piston to be equal on both sides, the pressure must be higher on the gas side, because the area affecting the force is smaller due to the piston rod. If the process devices must be tempered, it slightly affects the extent of the area. The temperature regulation, i.e. tempering, of the piston rod can be done by constructing the rod from nested pipes, which increases the external diameter of the piston rod. To ensure the operation of the rod seal, the external surface of the outer pipe must be precise and have a good surface quality. If the tempering is carried out completely by liquid circulation, all structures of the device will be ex-approvable. The structures of one embodiment may be tempered also in other ways to obtain the Ex-approval, for example electrotempered.

Because the operation of the device is regulated with a simple valve system and the other structures are very simple, the susceptibility of the device to faults is very low.

The drawings and the specification related thereto are only intended to illustrate the idea of the invention. It will be clear to a person skilled in the art that the invention is not limited to the above-described embodiments in which the invention is described by way of some examples, but many modifications and different applications of the invention are possible within the scope of the inventive idea defined by the claims presented hereinafter. The features possibly presented in combination with other features in the specification may also be applied separately, if needed.

REFERENCE NUMBERS

1 Feed channel, feed pipe
1' Feed aperture

2 Piston rod
3, 5 Container space
3 Gas side
4 Piston
5 Material side
6 Discharge passage, discharge pipe
6' Discharge aperture
7 Pressure medium source
8 Pressure reducing valve
9 Closing valve
10, 10' Pressure equalization arrangement
10 Pressure regulating valve
10' Pressure regulating valve
11 Closing valve
12 Temperature regulating arrangement
13 Pressure medium passage
14 Pressure sensor
20 Container
21 Container end wall
22 Container end wall
23 Inner wall of the container space

The invention claimed is:

1. A pressure-balancing feed-in container arrangement comprising:

a container forming a basic body, which container comprises a container space in which a piston is arranged in a movable manner, which container space comprises a first space portion and a second space portion which are separated from each other by the piston, the first space portion being a gas space of the container and the second space portion being a material space of the container, a feed passage for feeding material into the material space, a discharge passage for conducting the material from the material space, means for connecting a pressure medium source with the gas space of the container, a pressure regulating valve arrangement arranged between the pressure medium source and the gas space of the container, the pressure regulating valve arrangement having valves and being operatively configured to provide a desired pressure on the gas space by opening and closing a communication from the pressure medium source to the gas space and/or by releasing pressure from the gas space, and a pressure sensor operatively connected with the pressure regulating valve arrangement and configured to control the valves of the pressure regulating valve arrangement to provide the desired pressure on the gas space, whereby the piston is provided with a piston rod extending towards the gas space and further through a container wall to an exterior of the container, whereby the material feed passage extends through the piston rod and the piston to the material space.

2. The pressure-balancing feed-in container arrangement according to claim 1, wherein a material feed passage aperture of the feed passage and a discharge passage aperture of the discharge passage are disposed at opposite edges of the material space.

3. The pressure-balancing feed-in container arrangement according to claim 2, wherein the material feed passage aperture is arranged at a surface of the piston facing the material space and the discharge passage aperture is arranged at a wall of the material space opposite to the piston.

4. The pressure-balancing feed-in container arrangement according to claim 1, whereby the pressure medium source is a gas and/or liquid source.

5. The pressure-balancing feed-in container arrangement according to claim 1, whereby the pressure medium source is a source of an inert gas.

6. The pressure-balancing feed-in container arrangement according to claim 1, whereby several discharge passages are provided from the material space.

7. The pressure-balancing feed-in container arrangement according to claim 1, whereby a pressure difference is configured to act on different sides of the piston in the container space at equilibrium, whereby forces exerted on the piston are equal such that the pressure on the gas space higher than on the material space, due to a smaller area of the piston facing the gas surface affecting the forces, due to the piston rod.

8. The pressure-balancing feed-in container arrangement according to claim 1, which is operatively configured to act as a combination of a pressure equalization unit, an intermediate container, and a pump as a part of a continuously operated production line.

9. The pressure-balancing feed-in container arrangement according to claim 1, whereby the pressure-balancing feed-in container arrangement is configured to receive and feed a high-viscosity material.

10. The pressure-balancing feed-in container arrangement according to claim 1, whereby at least a part of the container and/or at least a part of the feed passage is temperature-regulated by a temperature regulating arrangement.

11. The pressure-balancing feed-in container arrangement according to claim 1, wherein the container is a cylindrical container closed at both ends.

12. The pressure-balancing feed-in container arrangement according to claim 1, whereby the piston is configured to move in the container space according to a difference in the pressures of the gas space and the material space.

13. The pressure-balancing feed-in container arrangement according to claim 1, whereby the pressure-balancing feed-in container arrangement is configured to equalize changes in the pressure of the material space by means of movement of the piston and the pressure regulating arrangement.

14. A method for the pressure-balancing feeding of material, wherein the material is introduced to the material space of the container space of the container of the pressure-balancing feed-in container arrangement according to claim 1 and conducted from there along the discharge passage, whereby in the method the pressure of the material is kept constant or at a desired value on the material space of the container space.

15. The method according to claim 14, whereby the pressure of the material on the material space is regulated by means of the piston and the pressure of the pressure medium source acting on the gas space of the container space.

16. The method according to claim 14, whereby the material to be fed is a high-viscosity substance.

17. The method according to claim 14, whereby the material is a homogeneous material dissolved from pulp by means of an ionic liquid.

18. The method according to claim 14, whereby internal pressure of the material is kept constant by means of variable volume of the material space and counterpressure of the pressure medium in the gas space.

19. The method according to claim 14, whereby during feeding, the material being fed is continuously replaced in the material space.

20. The method according to claim 14, whereby to maintain the properties of the material, devices of the pressure-balancing feed-in container arrangement are temperature-regulated by a temperature regulating arrangement.

* * * * *